US005934946A

United States Patent [19]

Nakamura

[11] Patent Number: 5,934,946

[45] Date of Patent: Aug. 10, 1999

[54] CONNECTOR

[75] Inventor: Hideto Nakamura, Yokkaichi, Japan

[73] Assignee: Sumitomo Wiring Systems, Ltd., Japan

[21] Appl. No.: 09/042,721

[22] Filed: Mar. 17, 1998

[30] Foreign Application Priority Data

Mar. 26, 1997 [JP] Japan ..... 9-073786
Dec. 16, 1997 [JP] Japan ..... 9-346910

[51] Int. Cl.[6] ..... H01R 13/434

[52] U.S. Cl. ..... 439/752; 439/489

[58] Field of Search ..... 439/752, 595, 439/489

[56] References Cited

U.S. PATENT DOCUMENTS 5,378,176 1/1995 Sasai ..... 439/752

5,797,772 8/1998 Sakurai et al. ..... 439/752

*Primary Examiner*—Gary Paumen
*Attorney, Agent, or Firm*—Banner & Witcoff, Ltd.

[57] ABSTRACT

Full engagement of a male and female connector is prevented if terminal retainers 13,36 are not fully inserted. A detecting protrusion 15 protrudes from the anterior end of a female connector housing 10. When a male retainer 36 is in a temporary stopping position, a female connector contact protrusion 55 is located inside a fitting detecting groove 50 that connects with a hood member 31. As a result, in the case where the retainer 36 is not completely fitted with the connector housing 30, the detecting protrusion 15 and the female connector contact protrusion 55 make contact, thereby preventing the female and male connectors from being fitted in the correct position. A female retainer 13 can engage the hood of a male connector housing in the usual way.

18 Claims, 13 Drawing Sheets

CONNECTOR

TECHNICAL FIELD

The present invention relates to an electrical connector wherein in a terminal fitting is doubly stopped by means of a retainer.

BACKGROUND TO THE INVENTION

FIGS. 30 and 31 of this specification show conventional male and female connectors 250 and 254 in a state prior to their being fitted together. The female connector 250 shown on the left hand side in the diagrams comprises a female connector housing 251 in which a female terminal fitting 253 is housed, and a pair of upper and lower retainers 252. The female terminal fitting 253 is retained by means of a lance 258, the retainers 252 serve to doubly stop the fitting 253, in a conventional manner, and have respective fitting protrusions 252A engaged with the female terminal fittings 253 to hold them in an unremovable state.

The male connector 254 also has a retainer 257 for doubly stopping a male terminal fitting 255. Furthermore, a hood member 259 is formed at its anterior end, this hood member being larger than the posterior side and serving to protect the terminal fitting 255. Consequently, in the case where the retainer 257 has not been pushed in to its correct position, it lies above the surface of the connector housing 256 and can be visually detected. However since this detection is visual, there is a possibility of the half-fitted state being overlooked. On the other hand, in the case of the female connector 250, during the fitting of the male and female connectors 250 and 254, a half-fitted retainer 252 will interfere with the open edge of the hood member 259 thereby preventing further insertion. In this manner the half-fitted state of the retainer 252 can be reliably detected.

Thus, in the case of the male connector 254, if the retainer 257 is in the half-fitted state, only a visual detection is possible. For this reason, in the conventional case, there is a loss of balance in the detection of the half-fitted state of the retainer with respect to the male connector 254 and the female connector 250.

The present invention has been developed after taking these problems into consideration, and aims to present a connector wherein the half-fitted state of a terminal fitting in the male connector is detected with the same certainty as in the case of the female connector.

SUMMARY OF THE INVENTION

According to a first aspect of the invention there is provided a connector assembly comprising male and female connector housings each having respective electrical terminals therein, wherein each housing further includes an insertable retainer movable between a temporary position in which respective terminals can be inserted and removed from the associated housing, and a final position in which the respective terminals are retained against removal from a respective housing, the housings each being adapted to retain retainers of the mating housing in the final position when the housings are fully connected.

Such a connector assembly has the advantage that the retainers cannot be disengaged, accidentally or deliberately, whilst the housings are fully engaged.

According to a second aspect of the invention there is provided a connector assembly comprising male and female connector housings each having respective electrical terminals therein, wherein each housing further includes an insertable retainer movable between a temporary position in which respective terminals can be inserted and removed from the associated housing, and a final position in which the respective terminals are retained against removal from a respective housing, the retainers each having an abutment engageable with the mating housing to prevent the housings being fully connected if both retainers are not in the final position.

Such a connector assembly has the advantage that it is not possible to push the housings to the fully engaged position whilst one or other of the retainers is in a half-fitted condition.

In a preferred embodiment both aspects of the invention are incorporated in a connector assembly.

Preferably the final stopping position of a retainer is located more deeply in a respective housing than the temporary position. This has the advantage that the temporary position can be determined by sight and touch. In a preferred embodiment the retainers are flush with the surface of a respective housing in the final position; this is again sensitive to both sight and touch, and is a clear indication of correct installation.

A guiding surface, preferably tapered, is advantageously provided between any retainer and a mating housing. In this way the retainer can be urged from the temporary position to the final position as the housings are moved to the fully engaged condition.

BRIEF DESCRIPTION OF DRAWINGS

Other features of the invention will be apparent from the following description of several preferred embodiments shown by way of example only in the accompanying drawings, in which.

DESCRIPTION OF PREFERRED EMBODIMENTS

A first embodiment of the present invention is explained below with the aid of FIGS. 1 to 15.

A connector of the present embodiment comprises a male connector M and a corresponding female connector F.

FEMALE CONNECTOR F

Figure 1:
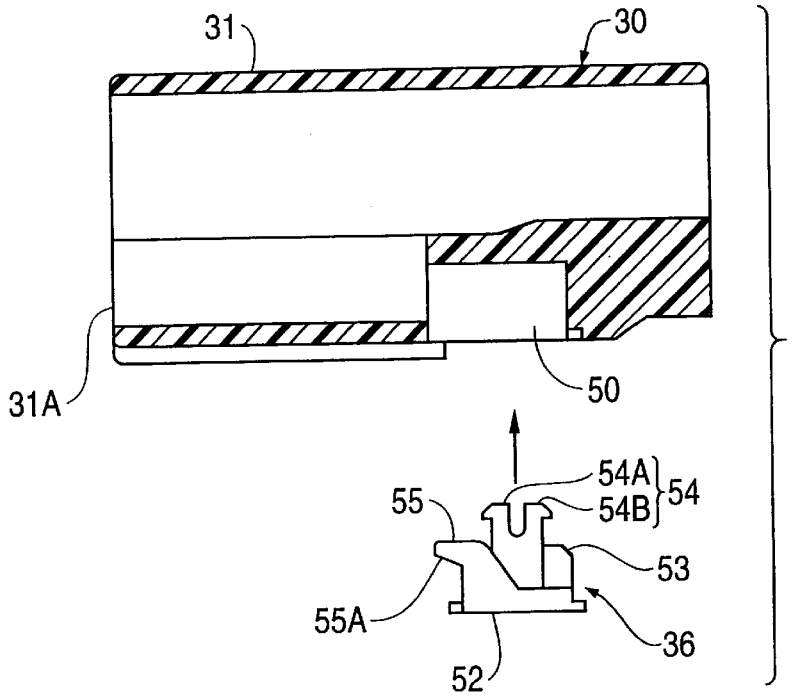
FIG. 1 is a cross-sectional view of the present invention showing a state prior to the attachment of a retainer to a male connector housing.
Figure 3:
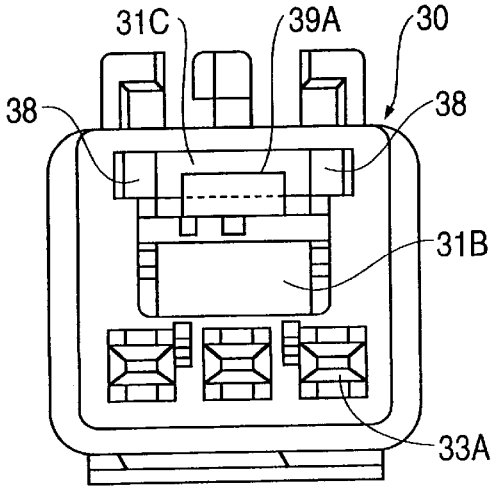
FIG. 3 is a rear view of the male connector housing.
Figure 2:
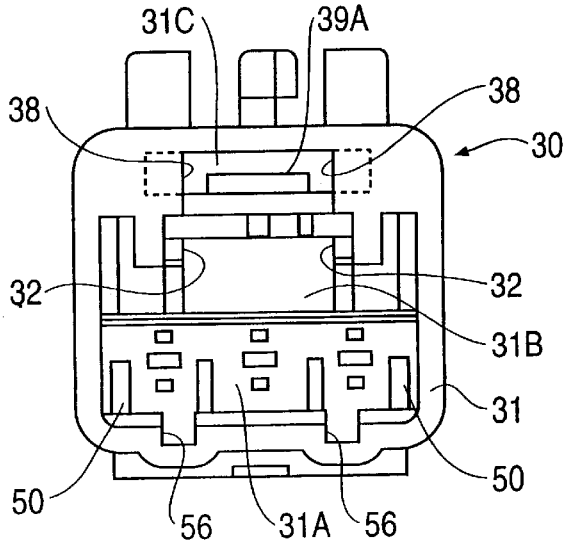
FIG. 2 is a front view of the male connector housing.
Figure 4:
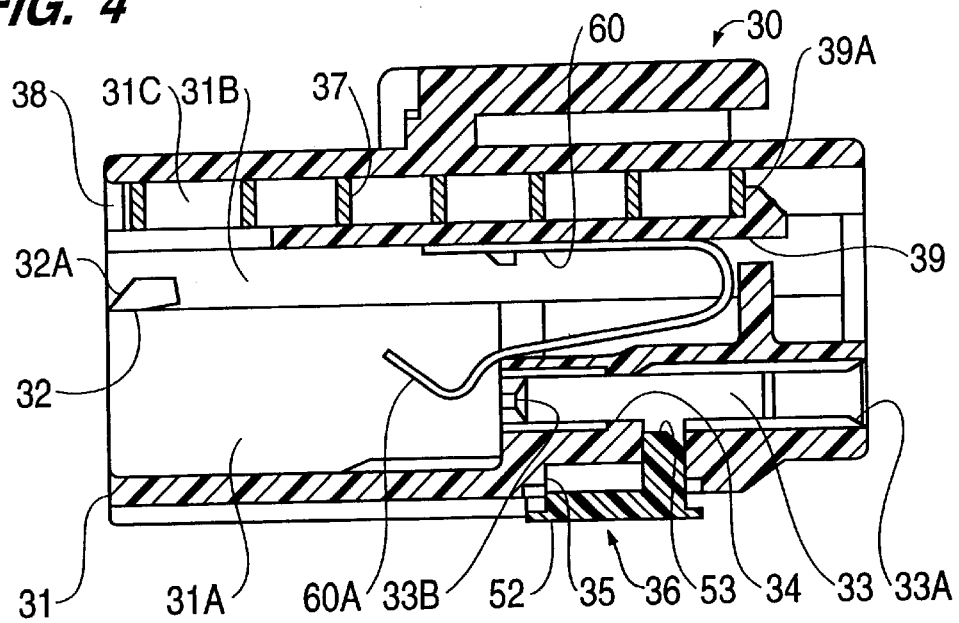
FIG. 4 is a side cross-sectional view showing the male connector housing and the retainer in a temporary stopping position.
Figure 5A:
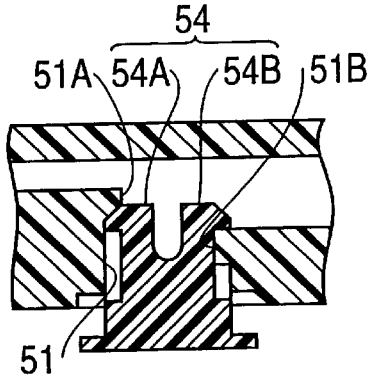
FIG. 5 is a side cross-sectional view showing the stopping portions whereby the retainer is stopped with the connector housing in a temporary stopping position or a main stopping position.
Figure 5B:
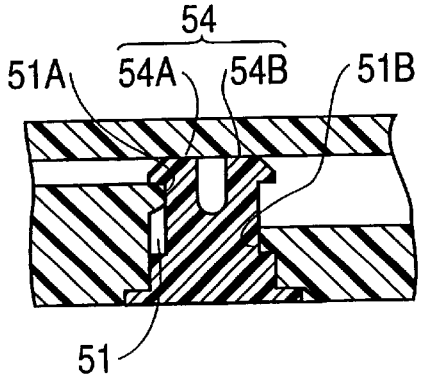
Figure 6:
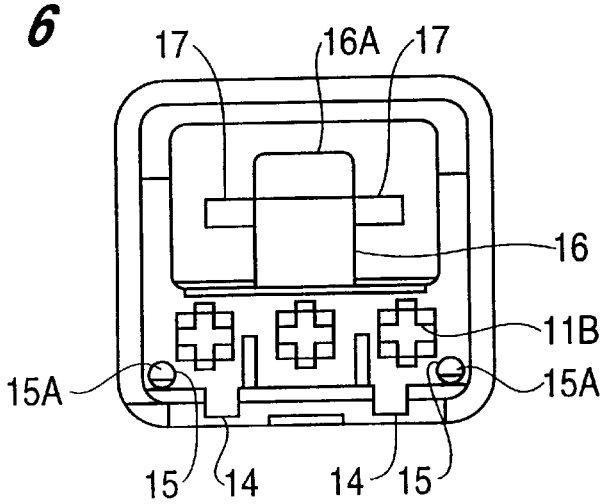
FIG. 6 is a front view of a female connector housing.
Figure 7:
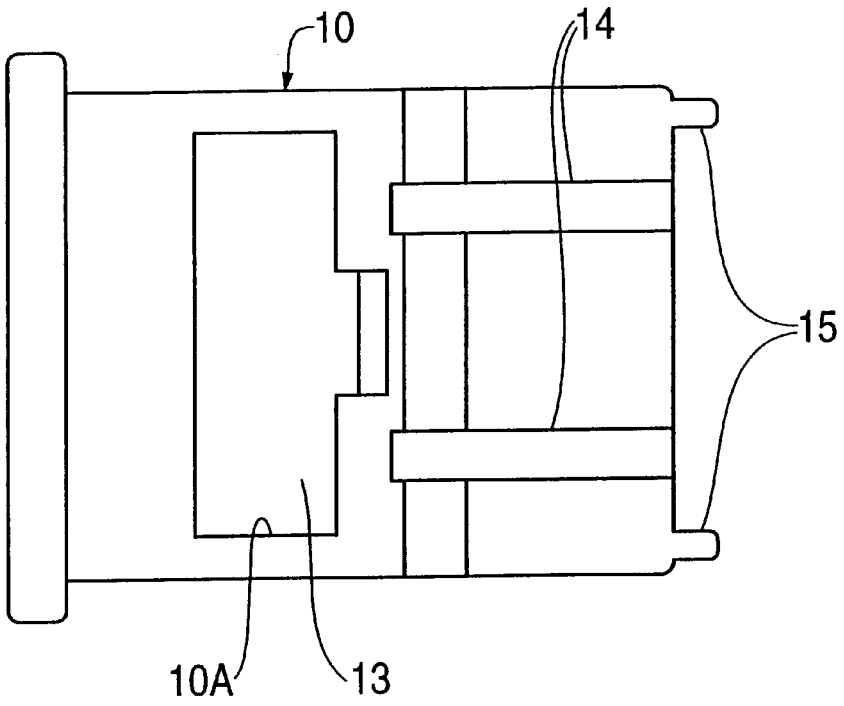
FIG. 7 is a view from below of the female connector housing.
Figure 8:
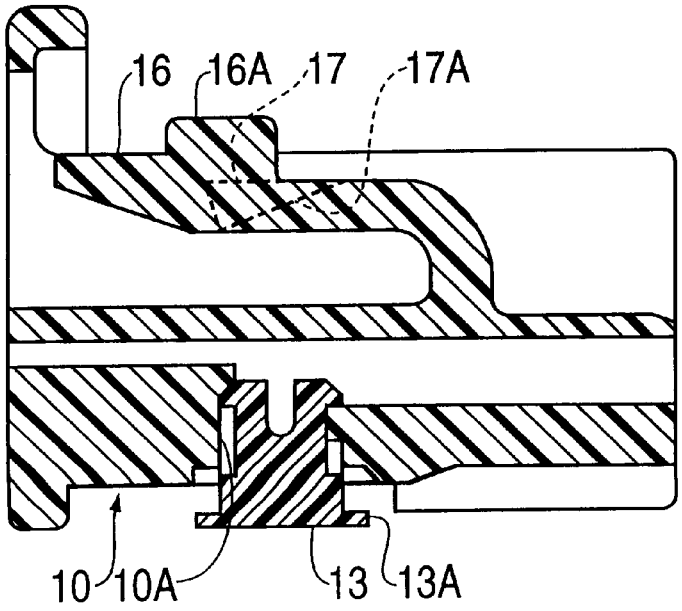
FIG. 8 is a side cross-sectional view of the female connector housing.
Figure 12:
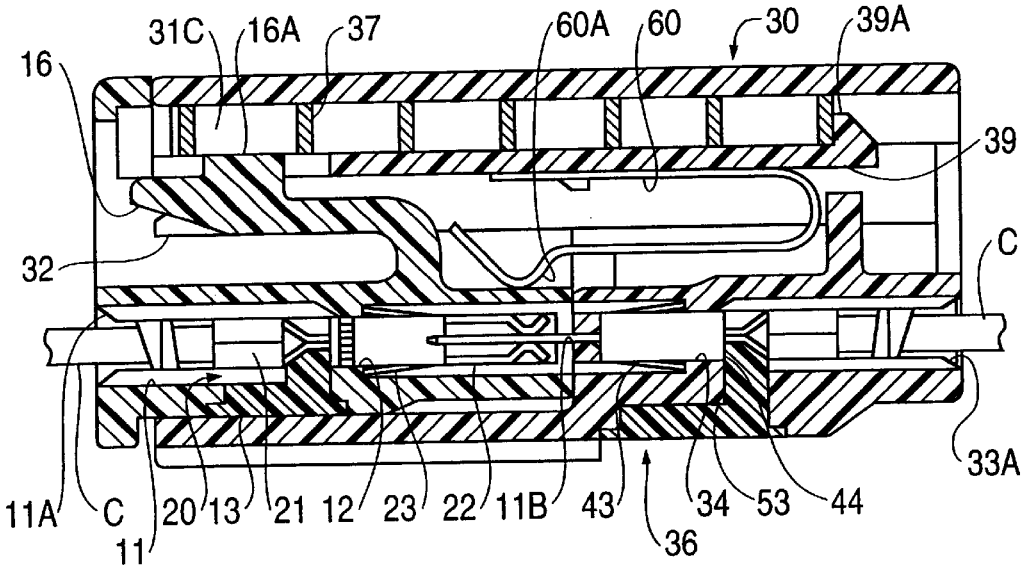
FIG. 12 is a side cross-sectional view showing a state where the female and male connectors are in the correct fitting position.
Figure 13:
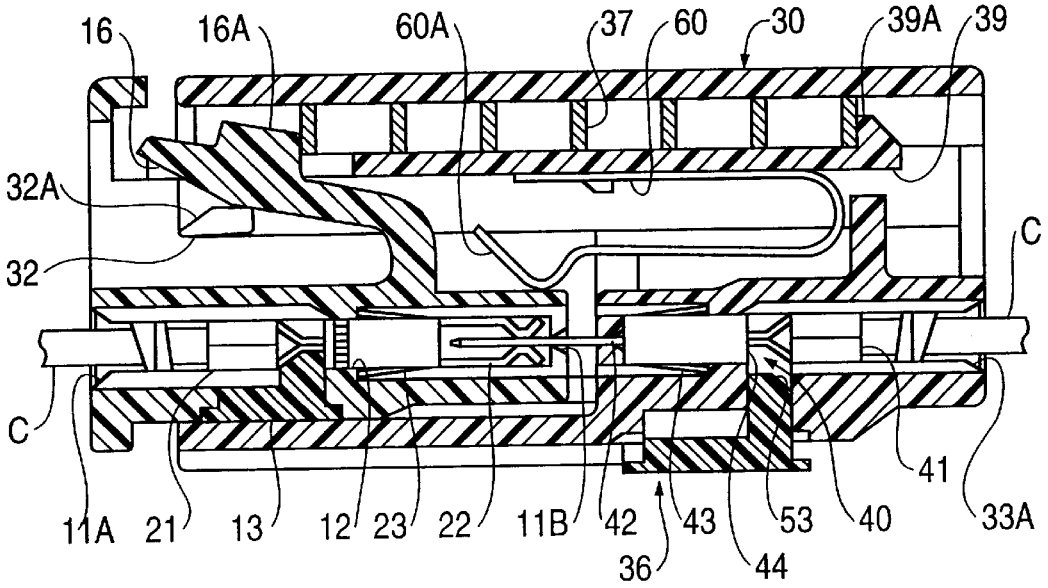
FIG. 13 is a side cross-sectional view showing the situation where the female and male connectors are fitted together in a state where the male connector housing and the retainer are not in the correct fitting position.
Figure 14:
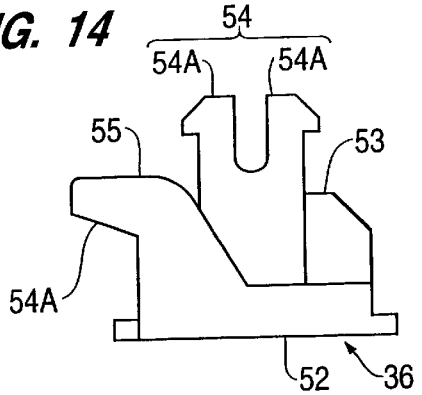
FIG. 14 is a side view of the male retainer.
Figure 15:
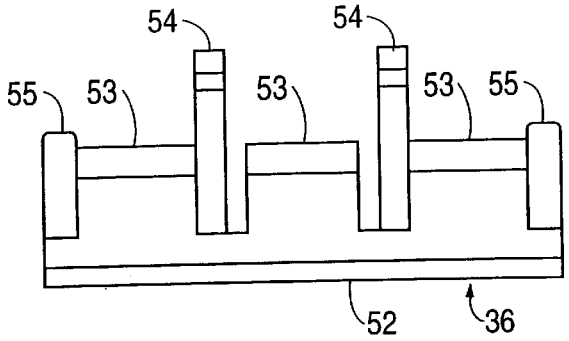
FIG. 15 is a rear face view of the male retainer.

As shown in FIG. 7 and FIG. 8, the female connector F comprises a rectangularly shaped connector housing 10 of synthetic resin, and a female terminal fitting 20, shown in FIG. 12 or FIG. 13, provided therein. The connector housing 10 has three cavities 11 aligned in a sideways direction (in FIG. 12 the direction perpendicular to the face of the paper), the female terminal fitting 20 being attached through a terminal attachment hole 11A formed in the posterior face thereof (the face opposite to the fitting face with the male housing M). The anterior face (the face at which the male connector M is fitted) of each cavity 11 has a terminal insertion hole 11B, so that when the female and male connectors F and M are fitted together, as described further on, the male terminal fitting 40 passes through the terminal insertion hole 11B and connects with the female terminal fitting 20. Further, each cavity 11 has a stopping protrusion 12 formed therein, which fits with a lance 23 formed on the female terminal 20, thereby holding the female terminal fitting 20 in an unremovable position.

The lower face of the connector housing 10 has an attachment recess 10A in which a retainer 13 is fitted. In the state preceding the attachment of the female terminal fitting 20, the retainer 13 can be supported in a temporary stopping position so as to protrude slightly from the lower face of the connector housing 10. After the female terminal fitting 20 is installed, the retainer 13 is pushed towards the connector housing 10 so that its upper end doubly stops the female terminal fitting 20.

When the retainer 13 is in the temporary stopping position and an attempt is made to fit the female connector F into the hood member 31 of the male connector M, the anterior end face 13A of the retainer 13 and the hood member 31 make contact. For this reason, the fact that the connector housing 10 and the retainer 13 are not completely fitted together is detected.

Figure 9:
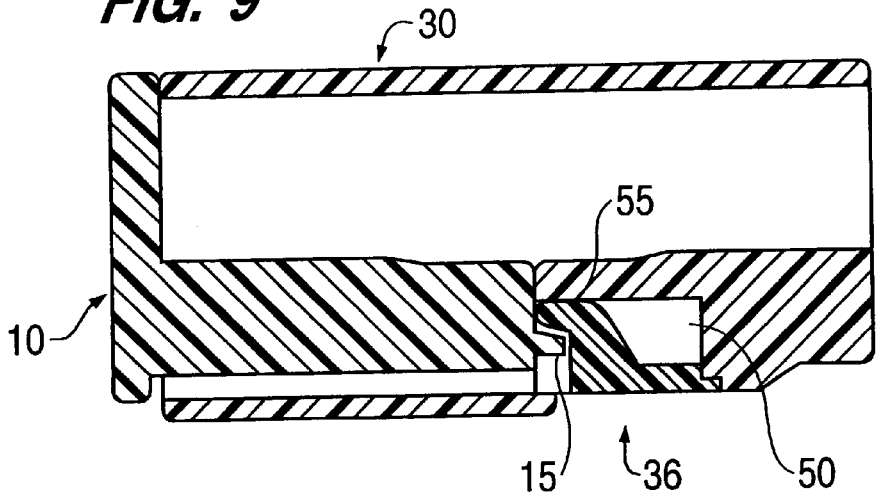
FIG. 9 is a side cross-sectional view showing the vicinity of the fitting detecting groove when the female and male connectors are correctly fitted together in the case where the male connector housing and the retainer are in the main stopping position.
Figure 10:
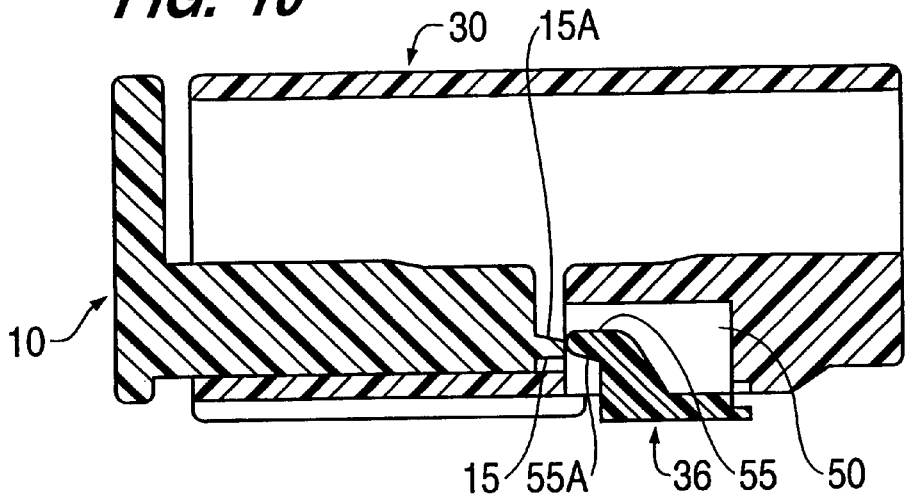
FIG. 10 is a side cross-sectional view showing the vicinity of the fitting detecting groove when the female and male connectors are fitted together in the case where the male connector housing and the retainer are in the temporary stopping position.
Figure 11:
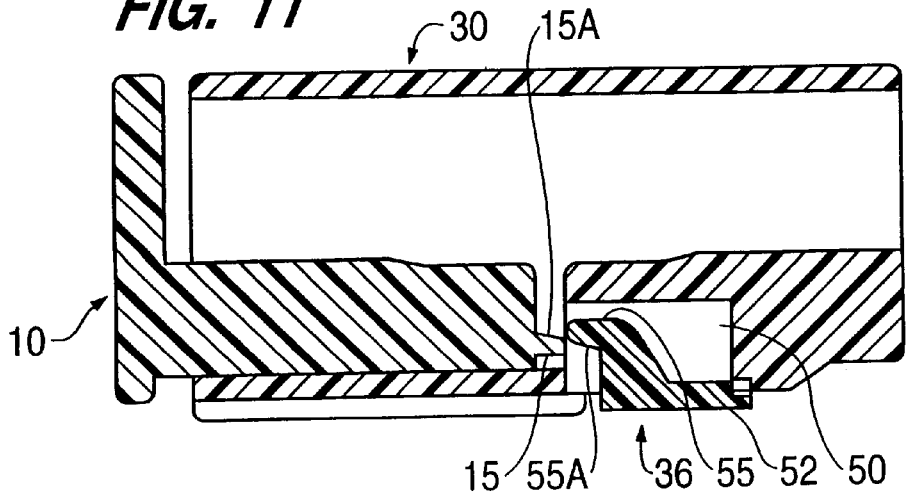
FIG. 11 is a side cross-sectional view showing the vicinity of the fitting detecting groove when the female and male connectors are fitted together in the case where the male connector housing and the retainer are in a position intermediate between the temporary stopping position and the main stopping position.

The lower face of the connector housing 10 has two sliding protrusions 14 formed so as to extend from the anterior end towards the posterior end. The lower portion of the anterior end face of the connector housing 10 has a pair of left and right detecting protrusions 15 which protrude axially. The upper sides of the anterior end portions of the detecting protrusions 15 form pressing faces 15A that are angled, as shown in FIGS. 9 to 11.

The upper face of the connector housing 10 has a cantilever locking arm 16 that is bendable, the upper face of the locking arm 16 having a pressing member 16A protruding therefrom. Furthermore, at a location somewhat anterior with respect to the location of the protruding pressing member 16A are formed a pair of fitting supporting protrusions 17 that extend outwards. The lower face portions of these protrusions 17 have gently sloping guiding faces 17A formed thereon, the posterior end portion being formed so as to be approximately vertical (as viewed).

The female terminal fitting 20 is formed by bending an electrically conductive metal sheet stamping, and comprises a barrel member 21 to which the anterior end of an electric wire C is connected, and a contact member 22 that engages the male fitting 20, thereby making contact with it. The barrel member 21 comprises a pair of insulation barrels that clamp the covered portion of the electric wire C, and a pair of wire barrels that clamp the core wire. The contact member 22 comprises a pair of resilient contact members that face each other, and a protecting tube-like member that covers these resilient contact members. A contact pin 42 of the male terminal fitting 40 is in use inserted between the resilient contact members. Furthermore, the tube-like member has a lance 23 formed thereon by shearing, the lance 23 fitting with the stopping protrusion 12 and thereby holding the female terminal fitting 20 in an unremovable position.

MALE CONNECTOR M

The male connector M comprises an approximately rectangularly shaped connector housing 30 made from synthetic resin, a male terminal fitting 40 which is housed therein, and a retainer 36 that doubly stops the male terminal fitting 40.

The anterior end of the connector housing 30 has a hood member 31 formed thereon for housing the female connector F. Its interior is partitioned so as to constitute a housing chamber 31A for housing the connector housing 10, an arm housing chamber 31B for housing the locking arm 16, and a spring housing chamber 31C for housing a returning spring 37.

The housing chamber 31A is formed in the lower portion inside the hood member 31 and the arm housing chamber 31B is formed above the housing chamber 31A so as to correspond to the position of the locking arm 16 of the female connector F. Further, the spring housing chamber 31C is formed above the arm housing chamber 31B. The posterior side of the housing chamber 31A has three cavities 33 mutually aligned in a parallel manner in a sideways direction (a direction perpendicular to that of the page in FIG. 4). The male terminal fitting 40 is inserted so as to protrude into the housing chamber 31A via a terminal attachment hole 33A formed in the posterior face (the right side in FIG. 4) of the cavity 33. The central portion of each cavity 33 has a stopping protrusion 34 formed thereon which fits with the lance 43 formed on the male terminal fitting 40, thereby stopping the male terminal fitting 40. Further, the anterior end of the cavity 33 has a fitting protrusion hole 33B that passes through to the housing chamber 31A, the contact pin 42 of the male terminal fitting 40 protruding therefrom.

The lower wall face of the housing chamber 31A has two sliding grooves 56 formed thereon, these fitting with the sliding protrusions 14 of the female connector housing 10.

The open end in the arm housing chamber 31B has a pair of fitting members 32 protruding inwards from the left and right wall faces. The anterior face of each fitting member 32 has a guiding face 32A formed on its upper side. When the female and male connectors F and M are fitted together, the guiding face 32A makes contact with the guiding face 17A of the fitting supporting protrusion 17 formed on the locking arm 16 of the female connector F, thereby guiding the locking arm 16 by bending it upwards (see FIG. 13).

The spring housing chamber 31C is formed so as to open towards the anterior and posterior sides of the connector housing 30, a returning spring 37, to be described below, being supported therein and bendable in a lengthwise direction. The anterior end portion of the spring housing chamber 31C has spring stopping walls 38 extending from both sides, and the central portion opens so as to be larger than the spring pressing member 16A of the locking arm 16. Moreover, the lower end face of the spring housing chamber 31C has a spring stopping member 39 protruding therefrom in a posterior direction from a location that is separated by a specified distance from the posterior end of the fitting member 32. This spring stopping member 39 is resiliently bendable in a downward direction and its anterior end has stopping claws 39A that stop the returning spring 37. The distance between the spring stopping wall 38 and the stopping claw 39A is either approximately the same as the length of the returning spring 37 or somewhat smaller.

The returning spring 37 is formed by bending a flat metal strip into a cross-sectionally wavy form, the metal plate having a width slightly less than that of the spring housing chamber 31C. The returning spring 37 is inserted into the spring housing chamber 31C from the posterior end thereof; the anterior end thereof fits with the spring stopping wall 38 and the posterior end is stopped by the stopping claws 39A. Accordingly, the returning spring 37 is retained and is compressible.

When the female and male connectors F and M are to be fitted together, the locking arm 16 bends upwards due to the engagement of the diagonal faces 17A and 32A. For this reason, the spring pressing member 16A is inserted from the anterior side of the spring housing chamber 31C and presses against the anterior end of the returning spring 37, thereby causing it to be compressed. Then, once the female and male connectors F and M reach the correct fitting position, the fitting supporting protrusion 17 passes beyond the fitting member 32. As a result, the locking arm 16 reverts to its original shape and comes to be located in the arm housing chamber 31B. As a result the spring pressing member 16A and the returning spring 37 no longer make contact, and the returning spring 37 reverts to its original length.

A retainer attachment member 35 is formed on the posterior portion of the lower face of the connector housing 30, the retainer 36 being attached thereto. The retainer attachment member 35 is formed between the left and right ends of the lower face of the connector housing 30 by being formed into a shallow plate shape, this retainer attachment member 35 connecting with each cavity 33. The two end portions of the retainer attachment member 35 constitute fitting detection grooves 50 that connect with the housing chamber 31A.

Further, a pair of retainer stopping grooves 51 are formed at locations that surround the central cavity 33. The anterior and posterior wall faces forming the retainer stopping groove 51 have stopping protrusions 51A and S1B protruding in a stepped manner, one higher than the other, as shown, in order to stop the retainer. The posteriorly located protrusion 51B protrudes less than the anteriorly located protrusion 51A.

The retainer 36 is made from synthetic resin and is capable of fitting with the connector housing 30 in a shallow manner in a temporary stopping position and in a relatively deeper location in a main stopping position. In the temporary stopping position the retainer 36 is not located inside the cavity 33. As a result, the male terminal fitting 40 is removable. In the main stopping position the retainer 36 is located inside the cavity 33 and the male terminal fitting 40 is doubly stopped. Consequently, the male terminal fitting 40 is retained in an unremovable state. The retainer 36 consists of a flat, plate shaped base member 52 and three kinds of protrusions 53, 54, 55 that protrude from the base member 52 (see FIGS. 14 and 15).

The terminal stopping protrusion 53 protrudes so as to correspond with the cavity 33 of the connector housing 30, this protrusion 53 fitting with the retainer stopping member 44 of the male terminal fitting 40. The pair of retainer stopping protrusions 54 provided so as to engage the centrally located terminal stopping protrusions 53 protrude higher than the terminal stopping protrusions 53, and serve to maintain the retainer 36 and the connector housing 30 in the two stopping positions described above. The anterior end portion of the retainer stopping protrusion 54 is divided into two stopping members 54A and 54B which are elastically bendable into the closing direction. The posteriorly located temporary stopping member 54B fits with the temporary stopping protrusion 51B of the retainer stopping groove 51 and thereby maintains the retainer 36 in the temporary stopping position. The anteriorly located main stopping member 54A fits with the main stopping protrusion 51A and thereby maintains the retainer 36 in the main stopping position (see FIGS. 5A, 5B).

The side portions of the retainer 36 have a pair of female connector contact protrusions 55 formed thereon. These end portions face in the anterior direction, the lower faces being diagonally shaped and thereby forming guiding faces 55A. When the retainer 36 is attached to the connector housing 30, the female connector contact protrusion 55 is located in the retainer stopping groove 51.

The interior of the arm housing chamber 31B has a fitting detecting shorting terminal 60 (to be described later) attached therein. This shorting terminal 60 is bent into a cross-sectionally U shape, the folded over portion being located towards the inner end. The lower end of the shorting terminal 60 is divided into two branch members located on the left and right sides (in FIG. 4 in the direction perpendicular to the face of the paper), each branch member 60A being bent so as to form a hump. In the attached state, both the branch members 60A respectively make contact with the anterior end portions of the two male terminal fittings 40 located on the right side when seen from the front (not shown in detail), the male terminal fittings 40 protruding into the housing chamber 31A. In this manner, the two male terminal fittings 40 are already in a conductive state before the female connector F is fitted into the hood member 31. When the female connector F is fitted completely into the hood member 31, the connector housing 10 of the female connector F pushes the branch member 60A downwards thereby making the male terminal fittings 40 non-conductive.

The male terminal fitting 40 comprises a barrel member 41 to which the end of an electric wire C is connected in the usual way, and a contact pin 42 that makes contact with the female terminal fitting 20. The contact pin 42 has a protective tube inserted therein and having a lance 43 in order to stop the male terminal fitting 40. Furthermore, the posterior end of the lance 43 has a retainer fitting member 44 that serves to fit with the terminal fitting protrusion 53 of the retainer 36.

Next, the operation and effects of the present embodiment are explained.

First, the connector housing 30 and the retainer 36 are attached in the temporary stopping position. Then the male terminal fitting 40 is inserted into the cavity 33 from the terminal attachment hole 33A. When the lance 43 passes over the stopping protrusion 34 and reverts to its original shape, the male terminal fitting 40 is in a stopped position. At this juncture, the contact pin 42 enters the housing chamber 31A and makes contact with the branch member 60A of the shorting terminal 60. Then, the retainer 36 is pushed into the connector housing 30 reaching the main stopping position.

Next, when the female connector F is attached to the hood member 31 of the male connector M, the fitting supporting protrusion 17 of the locking arm 16 makes contact with the fitting member 32 of the arm housing chamber 31B and the guiding faces 17A and 32A formed on both the members make contact with each other. As a result, the locking arm 16 is bent upwards in a resilient manner. At this juncture, the spring pressing member 16A enters into the spring housing chamber 31C and bends the returning spring 37. As the fitting operation continues, the fitting supporting protrusion 17 crosses over the fitting member 32 and the locking arm 16 reverts to its original shape. Along with this, the posterior end faces of the fitting supporting protrusion 17 and the fitting member 32 make contact and as a result the connectors are maintained in an unremovable state. Furthermore, the returning spring 37 passes above the spring pressing member 16A and reverts to its original shape.

During this period, in the lower portion of the connector housing 30, the pair of detecting protrusions 15 enter into the fitting detecting groove 50 and come to be located below the female connector contact protrusion 55 of the retainer 36 which is in the main stopping position (see FIG. 9). However, during this attachment operation if the operation ends with the female and male connectors F and M in an insufficiently fitted state, the returning spring 37 remains in a state whereby it continues to be pressed by the spring pressing member 16A; as a result, a force is exerted via the locking arm 16 causing the female connector F to be ejected out from the hood member 31. In this manner, an incomplete fitting of the female and male connectors F and M can be avoided.

A case was described above wherein the retainer 36 and the connector housing 30 had reached the correct main stopping position. However, in a real situation where the connectors are being attached, the fitting operation of the female and male connectors may be carried out in spite of the fact that the retainer 36 and the connector housing 30 are not attached in the main stopping position.

In the case where the retainer 36 is in a temporary stopping position with respect to the retainer attachment member 35, the female connector contact protrusion 55 comes to be located in the central portion of the fitting detecting groove 50 (see FIG. 10). In this state, if the fitting operation of the female and male connectors F and M is carried out, the detecting protrusion 15 and the female connector contact protrusion 55 make contact, and as a result the two connectors cannot be fitted in the correct position. Consequently, the operator realizes that the retainer 36 and the connector housing 30 are not in the main stopping position.

Furthermore, in the case where the retainer 36 and the connector housing 30 are pushed from the temporary stopping position towards the main stopping position but the main stopping position has not been reached, the female connector contact protrusion 55 comes to be located somewhat above the temporary stopping position. In such a case, when the detecting protrusion 15 reaches the location of the female connector contact protrusion 55, the diagonal faces 15A and 55A formed on both the members make contact. Accordingly, when the female connector F is further pushed into the male connector M the face 15A presses the retainer 36 upwards via the face 55A in the direction of the main stopping position. Then, when the female and male connectors F and M reach the correct fitting position, the retainer 36 is pushed into the main stopping position (see FIG. 11).

The above embodiment has the following effects.

(1) In the case where the retainer 36 and the connector housing 30 are in the temporary stopping position, when the female connector F is inserted into the hood member 31, the detecting protrusion 15 and the connector contact protrusion member 55 interfere with each other. As a result, the female connector F cannot be fitted correctly. In this manner the operator can detect with certainty that the retainer 36 is in the half-fitted position.

(2) In the case where the retainer 36 is not in the correct position and is operated from the temporary stopping position, due to the pressing of the upper face 15A and the guiding face 55A, the retainer 36 is guided into the correct position. As a result, the retainer 36 is corrected so as to be attached in the correct position, thereby ensuring that the male terminal fitting cannot be removed.

(3) In the case where the female connector F has not reached the correct position due to the half-fitted state or the like of the retainer 36, the locking arm 16 keeps the returning spring 37 compressed. As a result, the spring pressure causes the female connector F to be pushed, thereby allowing the operator to detect the half-fitted state with greater certainty.

Next, a second embodiment of the present invention is explained with the help of FIGS. 16 to 28.

In the second embodiment, there is a female connector F2 and a male connector M2 that mutually fit together. In the following explanation, the end faces of the connectors F2 and M2 that mutually fit together will be regarded as the anterior side.

Figure 16:
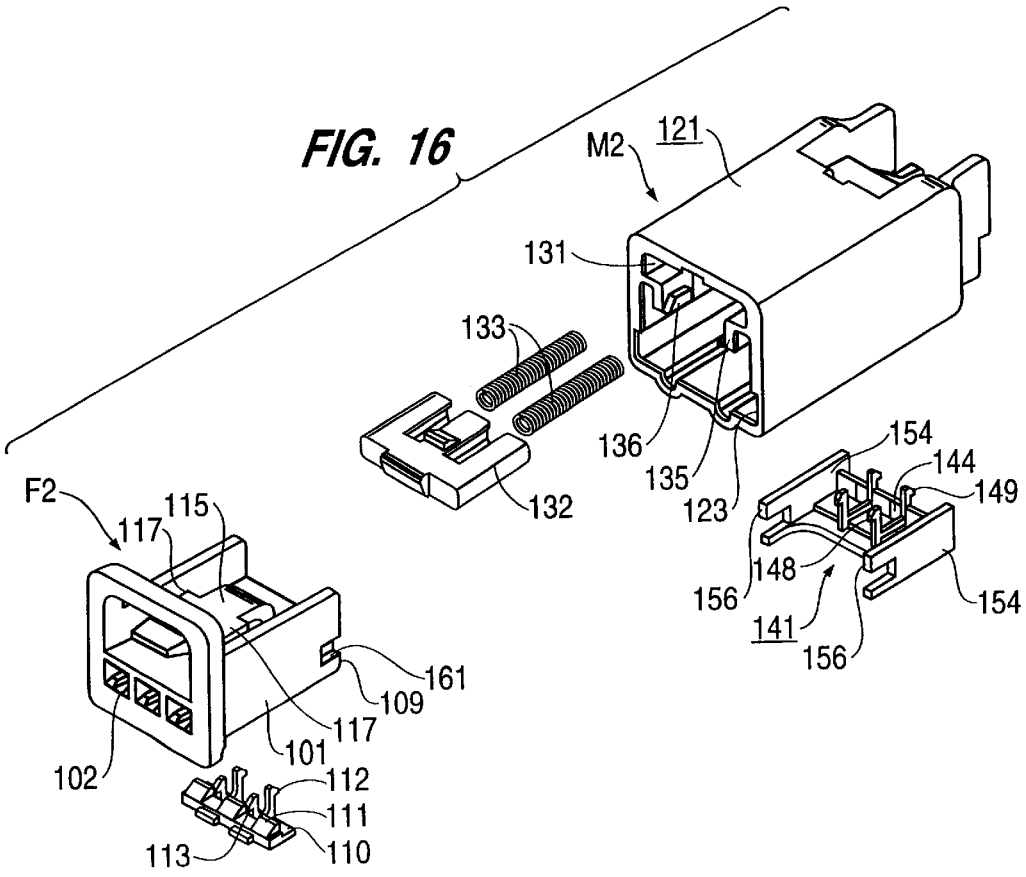
FIG. 16 is a disassembled diagonal view of a second embodiment.
Figure 17:
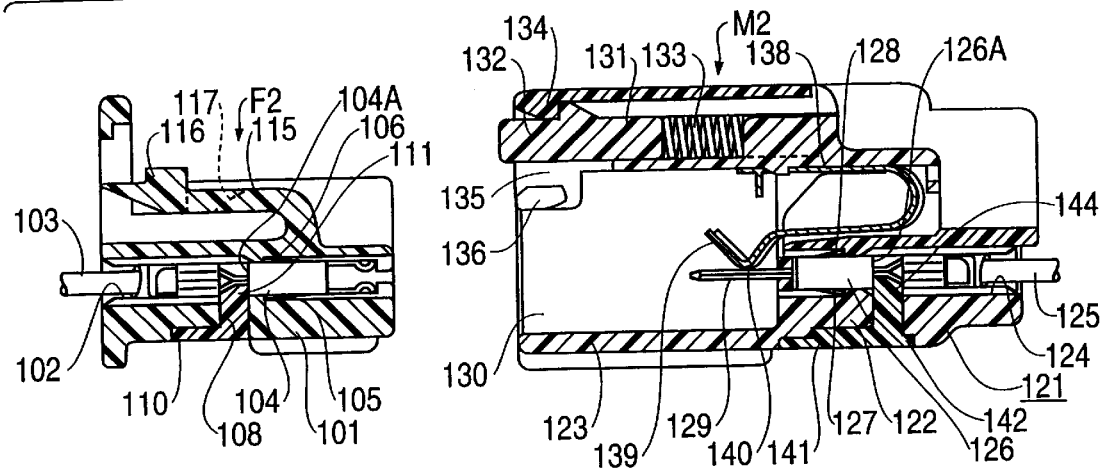
FIG. 17 is a vertical cross-sectional view of female and male connectors in a state prior to being fitted together.

As shown in FIGS. 16 and 17, the female connector F2 comprises a female housing 101 formed from synthetic resin into a block shape. Three cavities 102 are formed in a laterally aligned manner. A female terminal fitting 104 is inserted from the posterior end into each cavity 102, the female terminal fitting 104 being connected to the end of an electric wire 103. A stopping member 106 is formed inside the cavity 102. A lance 105 of the female terminal fitting 104 is stopped by the stopping member 106, thereby causing the female terminal fitting 104 to be retained inside the cavity 102.

The lower face of the female housing 101 has a concave retainer attachment hole 108, to receive a retainer 110. The retainer 110 has a fitting protrusion 111, which fits with a member 104A of the female terminal fitting 104, thereby causing the female terminal fitting 104 to be doubly stopped. Furthermore, the retainer 110 has a temporary stopping foot 112 and a main stopping foot 113. When the retainer 110 is attached to the female housing 101, first the temporary stopping foot 112 and the fitting member (not shown) of the female housing 101 fit together, resulting in a temporary stopping position being maintained. At this juncture, since the fitting protrusion 111 is lower than the lower face of the cavity 102, the removal and insertion of the female terminal fitting 104 is possible, as described above. Next, after inserting the female terminal fitting 104, when the retainer 110 is pushed in, the main stopping foot 113 fits with the fitting member (not shown) of the female housing 101, resulting in the final stopping position being achieved. At this juncture, the fitting protrusion 111 protrudes into the cavity 102 and fits with the posterior face of the member 104A of the female terminal fitting 104, resulting in the female terminal fitting 104 being doubly stopped.

In the case where the retainer 110 is stopped in the temporary stopping position, a portion of the retainer 110 protrudes from the lower face of the female housing 101. For this reason, if the female connector F2 is fitted into a hood member 123 of a male housing 121, to be described later, while in this temporary stopping position, the retainer 110 strikes against the anterior end of the hood member 123, thereby preventing further insertion. This allows the half-fitted state of the retainer 110 to be easily detected.

The upper face of the female housing 101 is folded over from the anterior end towards the posterior side, thereby forming an overhanging resilient and bendable locking arm 115. The upper face of this locking arm 115 has a pressing member 116 protruding therefrom, and the side edges, somewhat to the anterior with respect to the pressing member 116, have a pair of locking protrusions 117 extending outwards therefrom.

The male connector M2 comprises a male housing 121 made from synthetic resin. The posterior end of the male housing 121 has a cavity 124 which allows the insertion of a male terminal fitting 126 (the posterior end of the male housing 121 will be referred to as the main member 122 hereafter). The end located anteriorly with respect to the main member 122 has a hood member 123 formed thereon which fits with the female housing 101.

The main member 122 has three cavities 124 aligned laterally, a male terminal fitting 126 being inserted from the posterior end into each cavity 124, the male terminal fitting 126 having the end of an electric wire 125 connected thereto. A lance 127 is provided on the male terminal fitting 126, this lance 127 fitting with a stopping member 128 formed inside the cavity 124, thereby causing the male terminal fitting 126 to be retained therein. Further, a tab 129 of the male terminal fitting 126 protrudes inside the hood member 123.

This male housing 121 has a retainer 141 for doubly stopping the male terminal fitting 126.

A connector housing chamber 130 is formed inside the hood member 123 and extends from the centre downwards. The female connector F2 is housed therein.

The upper side of the interior of the hood member 123 has a spring housing chamber 131 which opens out toward the anterior face. This spring housing chamber 131 has a pressed member 132 that is freely moveable in the anterior-posterior direction. This pressed member 132 is pressed by the pressing member 116 of the locking arm 115 when the connectors F2 and M2 are fitted together. The posterior face of the pressed member 132 has two coiled returning springs 133. The pressed member 132 is normally positioned in its anterior direction due to the force exerted by the returning springs 133, and is stopped by a stopping member 134 protruding from the roof face of the spring housing chamber 131. The anterior end of the base face of the spring housing chamber 131 is open and its side edges have walls 135 extending downwards. The inner face of this wall 135 has a stopping protrusion 136 formed thereon. The locking protrusion 117 passes over this stopping protrusion 136 when the connectors F2 and M2 are fitted together. Further, when the fitting of the connectors F2 and M2 is completed, the locking protrusion 117 fits with the posterior face of the stopping protrusion 136 and the connectors F2 and M2 reach an unremovable state.

The space above the cavity 124 in the main member 122 has a shorting terminal 138 attached therein. This shorting terminal 138 is formed by folding an electrically conductive metal plate into a cross-sectionally U-shape. Its upper face is fixed and the folded over portion faces the inner side. The lower face of this shorting terminal 138 is divided into three branches so as to correspond with the number of male terminal fittings 126 housed therein, each branching member 139 having a contact member 140 which is bent in a humped shape and faces downwards from the anterior end of each branching member 139. When the shorting terminal 138 is in an attached state, the contact member 140 of each branching member 139 makes contact with tabs 129 of the male terminal fittings 126, thereby resulting in the male terminal fittings 126 being in an electrically conductive state. In this manner, any potential difference between the male terminal fittings 126 is prevented from occurring. When the connectors F2 and M2 are fitted together, each branching member 139 is pushed upwards in a resilient manner by the female housing 101 and these separate from the tabs 129 resulting in the male terminal fittings 126 reaching a non-contact state (see FIG. 24).

Figure 18:
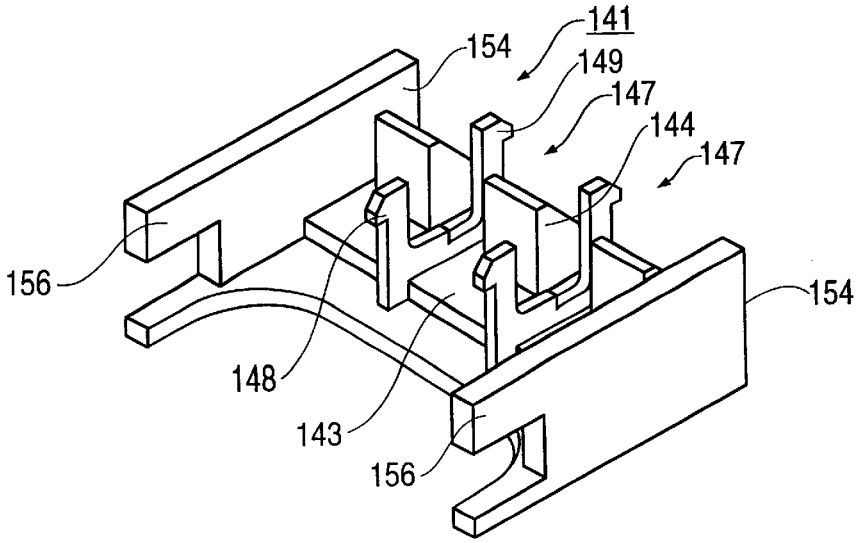
FIG. 18 is a diagonal view of a retainer.
Figure 19:
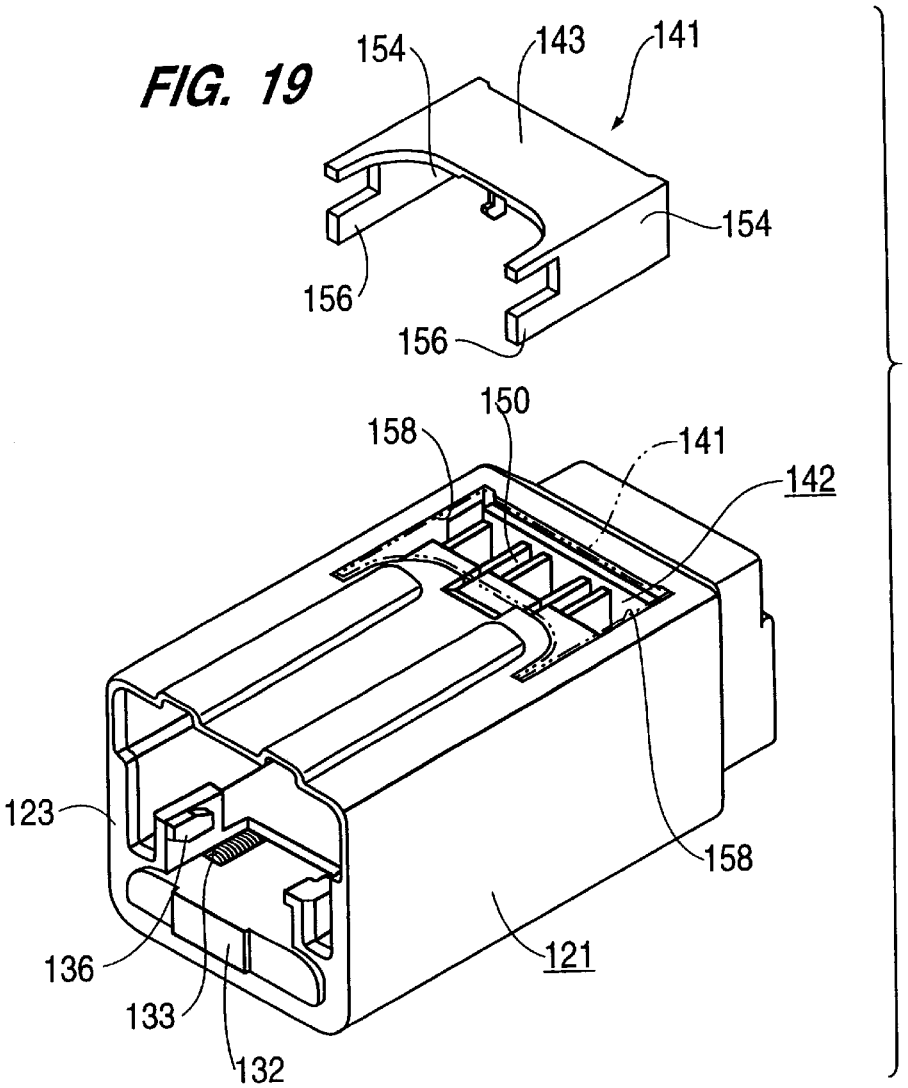
FIG. 19 is a disassembled diagonal view of the male connector seen from the rear face.

Further, as shown in FIG. 19, the lower face of the main member 122 has a retainer attachment hole 142, to receive a retainer 141. As shown in FIG. 18, the retainer 141 has three fitting protrusions 144, formed on the upper face of a base plate 143, which fit with the posterior face of the member 126A of the male terminal fitting 126.

The positions between the fitting protrusions 144 have two sets of retainer stopping protrusions 147 formed thereon. The anterior end portions of the retainer stopping protrusions 147 are divided into two portions which form a temporary stopping foot 148 and a main stopping foot 149, these being bendable towards each other in a resilient manner.

Figure 20A:
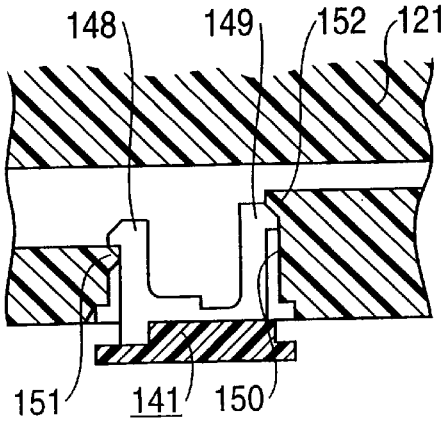
FIG. 20 is a cross-sectional view showing the stopping operation of the retainer.
Figure 20B:
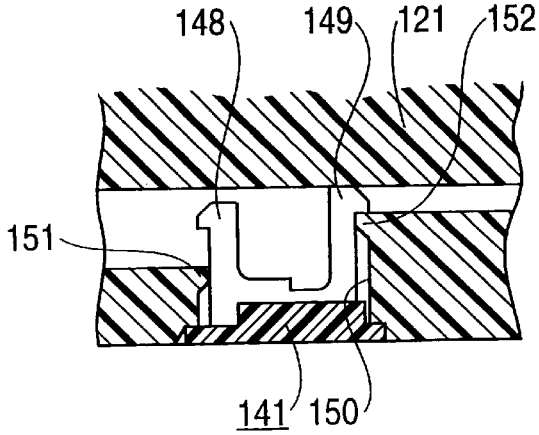

The male housing 121 has a pair of retainer stopping grooves 150 formed on both sides, these surrounding the centrally located cavity 124. The anterior edge of the retainer stopping groove 150 has a temporary stopping position receiving member 151 formed thereon. The posterior edge of the retainer stopping groove 150 has a main stopping receiving member 152 protruding therefrom, this being located in a position deeper than the temporary stopping position receiving member 151 (see FIGS. 19 and 20). As shown in FIG. 20(A), when the temporary stopping foot 148 is engaged, the retainer 141 is maintained in the temporary stopping position. In this temporary stopping position, the stopping protrusion 144 is lower than the lower face of the cavity 124. As a result, the male terminal fitting 126 can be removed or inserted in the cavity 124. Next, as shown in FIG. 20(B), the retainer 141 is pushed in further to engage the main stopping foot 149. In this main stopping position the stopping protrusion 144 protrudes inside the cavity 124 and is stopped by the member 126A of the male terminal fitting 126.

The left and right side edges of the retainer 141 have a pair of removal preventing members 154 extending therefrom. The anterior sides of these removal preventing members 154 are cut away from a central portion downwards, causing the upper end to protrude in an anterior direction, this protruding portion constituting the contact protrusion 156.

As shown in FIG. 19, in the female housing 121 the left and right edges of the retainer attachment hole 142 have removal preventing member insertion grooves 158 for allowing the insertion of the removal preventing members 154. The anterior sides of the insertion grooves 158 are provided so as to extend along the inner side of the side wall of the hood member 123, and connect with the connector housing chamber 130.

The left and right side faces of the anterior end portion of the corresponding female housing 101 have stopping grooves 161 formed thereon for fitting with the contact protrusions 156 of the male retainer 141. The stopping grooves 161 are located in such a position that the contact protrusions 156 fit therein when the retainer 141 is in the main stopping position. A detecting member 109 extends from the stopping groove 161 to the base face of the female housing 101, and when the retainer 141 is in a half-fitted state with respect to the male housing 121, the contact protrusion 156 and the detecting member 109 make contact.

Next, the operation and effects of the second embodiment are explained.

Figure 21:
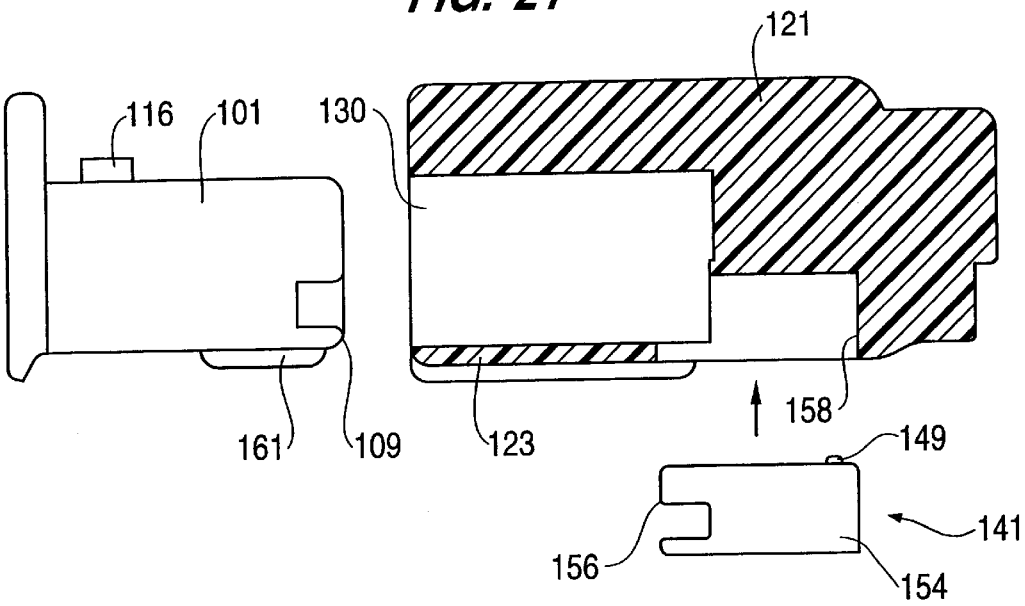
FIG. 21 is a partially cut-away side view of the male and female connectors prior to being fitted together.
Figure 22:
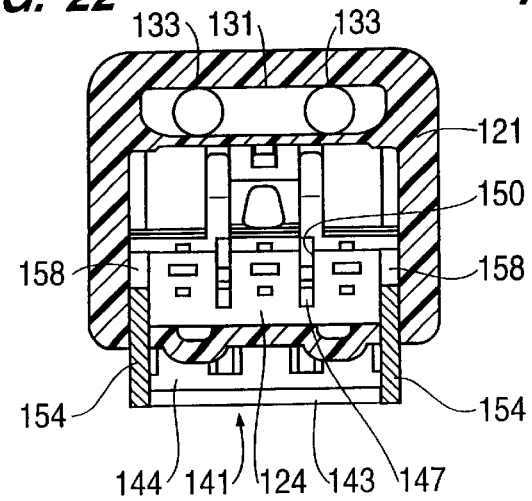
FIG. 22 is a lateral cross-sectional view of the male connector with the retainer in a temporary stopping position.
Figure 23:
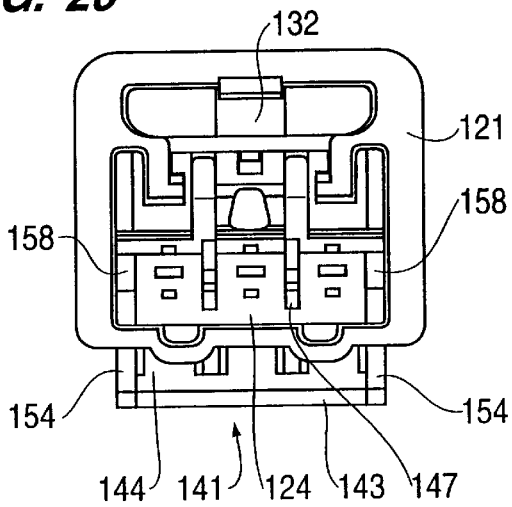
FIG. 23 is a front view of the male connector.

First, as shown by the arrow in FIG. 21, when the retainer 141 is inserted into the retainer attachment hole 142, as shown in FIG. 20(A), the temporary stopping foot 148 is engaged by the receiving member 151, thereby supporting the retainer 141 in the temporary stopping position. At this juncture, the removal preventing members 154 are in an inserted state in the insertion grooves 158, and the stopping protrusion 144 is in a retreated state towards the lower face of the cavity 124.

When the male terminal fitting 126 is inserted into the cavity 124, the male terminal fitting 126 is retained by the lance 127. At this juncture, the tab 129 of the male terminal fitting 126 protrudes into the hood member 123 and makes contact with the corresponding branching members 139 of the shorting terminal 138.

Next, when the retainer 141 is pushed in further, as shown in FIG. 20(B), the main stopping foot 149 is engaged by the receiving member 152 and the retainer 141 is supported in the main stopping position. Along with this, as shown in FIG. 17, the stopping protrusion 144 protrudes inside the cavity 124 and is stopped towards the posterior side of the member 126A of the male terminal fitting 126, thereby causing the male terminal fitting 126 to be doubly stopped.

Figure 24:
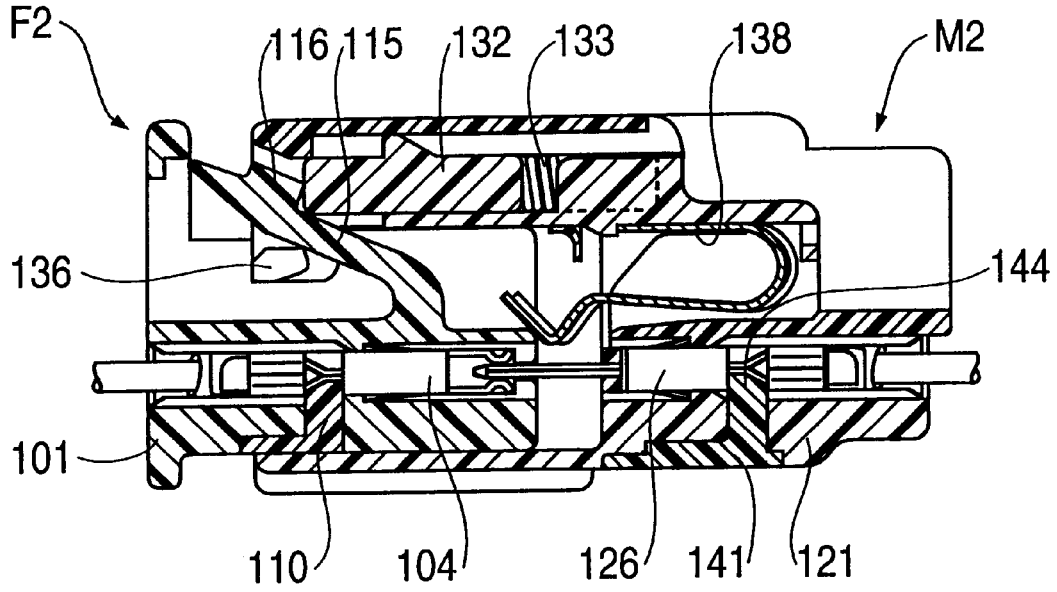
FIG. 24 is a vertical cross-sectional view of the male and female connectors during their fitting operation.
Figure 25:
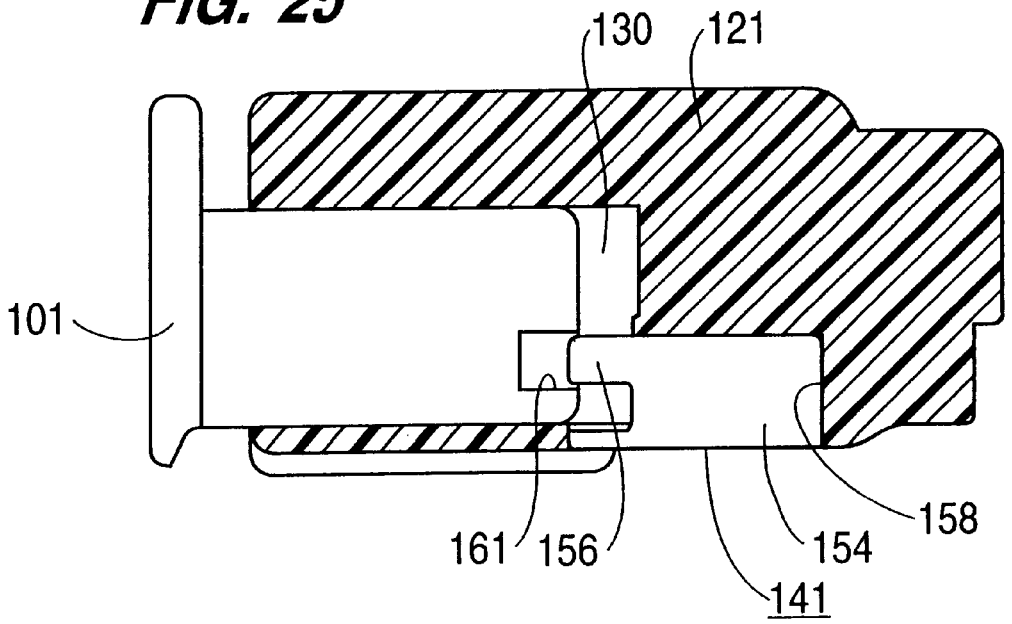
FIG. 25 is a vertical cross-sectional view showing a portion of a detecting member of the retainer.

In the case of the female connector F2, the female terminal fitting 104 is inserted into the cavity 102 and is stopped by means of the retainer 110. next, the female connector F2 is inserted into the hood member 123 of the male connector M2. During the fitting operation, as shown in FIG. 24, the locking protrusion 117 of the locking arm 115 passes over the stopping protrusion 136 and the locking arm 115 bends upwards in a resilient manner. The pressing member 116 resists against the resilient force of the returning springs 133 and pushes against the pressed member 132. During this fitting operation, as shown in FIG. 25, in the case where the retainer 141 of the male connector M2 is in the main stopping position, the positions of the stopping protrusion 156 and the stopping groove 161 of the female housing 101 correspond with each other, and the contact protrusion 156 enters into the stopping groove 161 and the fitting continues.

Figure 26:
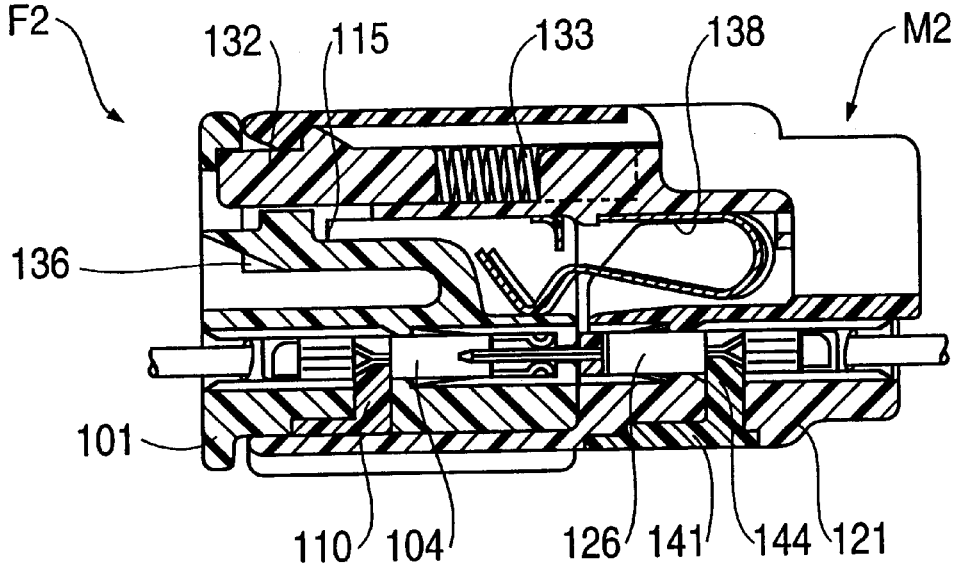
FIG. 26 is a vertical cross-sectional view of the male and female connectors in the correct fitting position.
Figure 27:
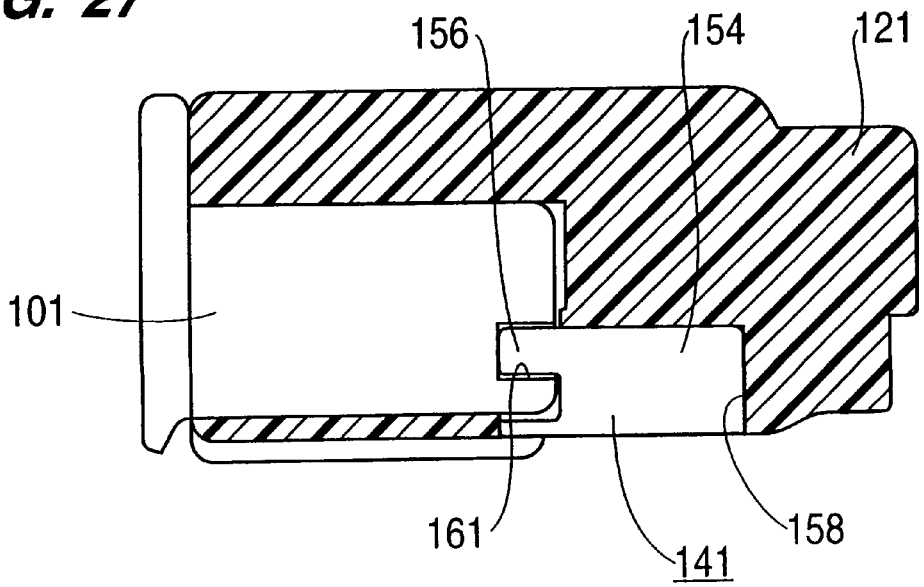
FIG. 27 is a vertical cross-sectional view showing a portion of the detecting member of the retainer.

When the connectors F2 and M2 are correctly fitted together, as shown in FIG. 26, the locking protrusion 117 passes over the stopping protrusion 136 and as a result the locking arm 115 revert to its original shape. When this happens, the locking protrusion 117 is engaged by the posterior face of the stopping protrusion 136, thereby causing the connectors F2 and M2 to be locked in the correctly fitted state. Further, the pressed member 132 is returned to its anterior position due to the recovery force of the returning springs 133. As shown in FIG. 27, the contact protrusion 156 enters deeply into the stopping groove 161, and as a result the retainer 141 is unremovably stopped in the main stopping position by means of the corresponding female connector F2.

During the fitting operation of the connectors F2 and M2 described above, if the operation is stopped before the correct fitting position is reached, as shown in FIG. 24, the locking arm 115 receives a force in the returning direction due to the recovery force of the returning springs 133, thereby causing the female connector F2 to be pushed outwards. This prevents the connectors F2 and M2 from remaining in a half-fitted state.

Next, the fitting operation of the connectors F2 and M2 is explained in the case where, during the fitting operation, the retainer 141 and the male housing 121 are not in the correct main stopping position. These are cases such as when the retainer 141 has inadvertently not been pushed into the main stopping position, or the retainer 141 remains in the temporary stopping position due to the male terminal 126 being in the half-fitted position, which prevents the retainer from being pushed in due to the fact that the stopping protrusion 144 makes contact with the main body of the male terminal fitting 126.

Figure 28:
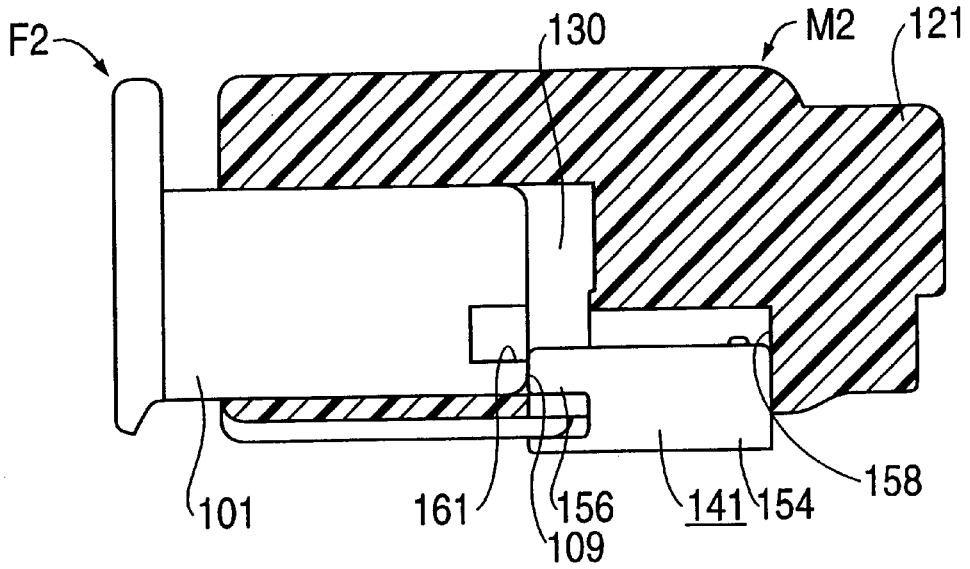
FIG. 28 is a vertical cross-sectional view showing the detection of a half-fitted state of the retainer.

As shown in FIG. 28, in the case where the retainer 141 is in the temporary stopping position, the removal preventing member 154 provided on the retainer 141 cannot be pushed up to the interior of the removal preventing member insertion groove 158. Consequently, the stopping protrusion 156 comes to be located at the location of the detecting member 109 of the corresponding female housing 101. As a result, as the fitting operation of the connectors F2 and M2 is about to be completed, the detecting member 109 and the contact protrusion 156 make contact and thereby make it impossible for the fitting operation to proceed further. If the fitting operation is stopped before the correct fitting protrusion has been reached, due to the force exerted by the returning springs 133, the female connector F2 is pushed outwards, thereby clearly indicating that the correct position was not reached. The operator can thus clearly determine that the retainer 141 is not in the correct stopping position due to the fact that the connectors F2 and M2 cannot be correctly fitted together.

Once the half-fitted state of the retainer 141 is detected, the state of insertion of the male terminal fitting 126 is confirmed and the retainer 141 is pushed in into the main stopping position, and then the connectors F2 and M2 are fitted together.

Figure 29:
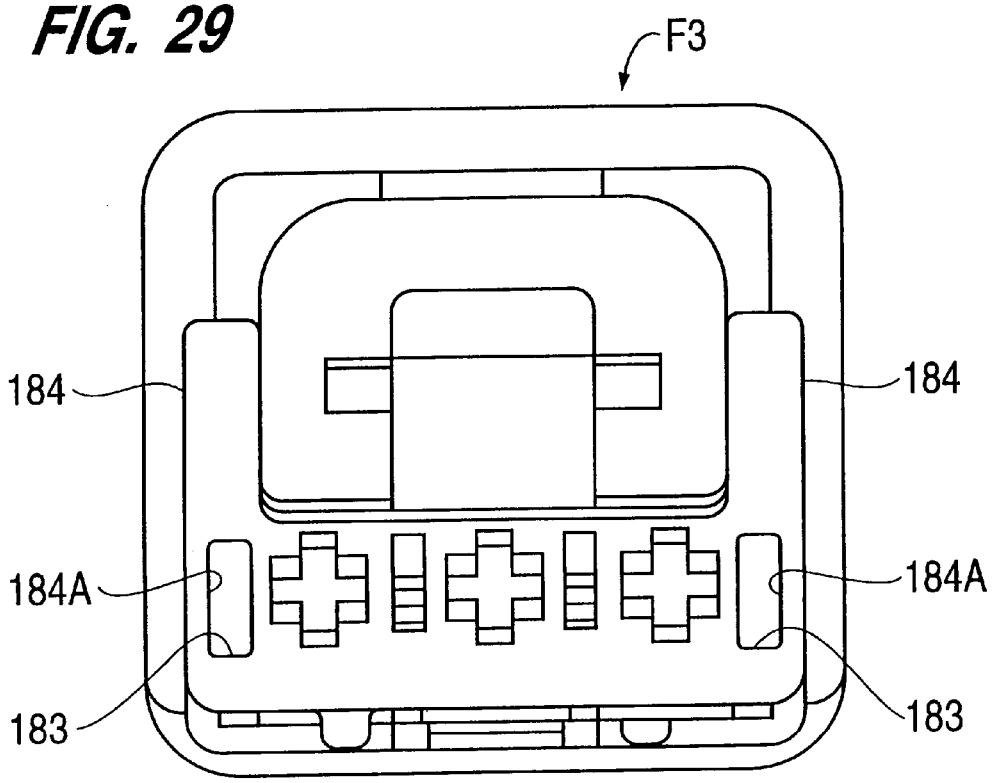
FIG. 29 is a front view of a female connector of a third embodiment.
Figure 30:
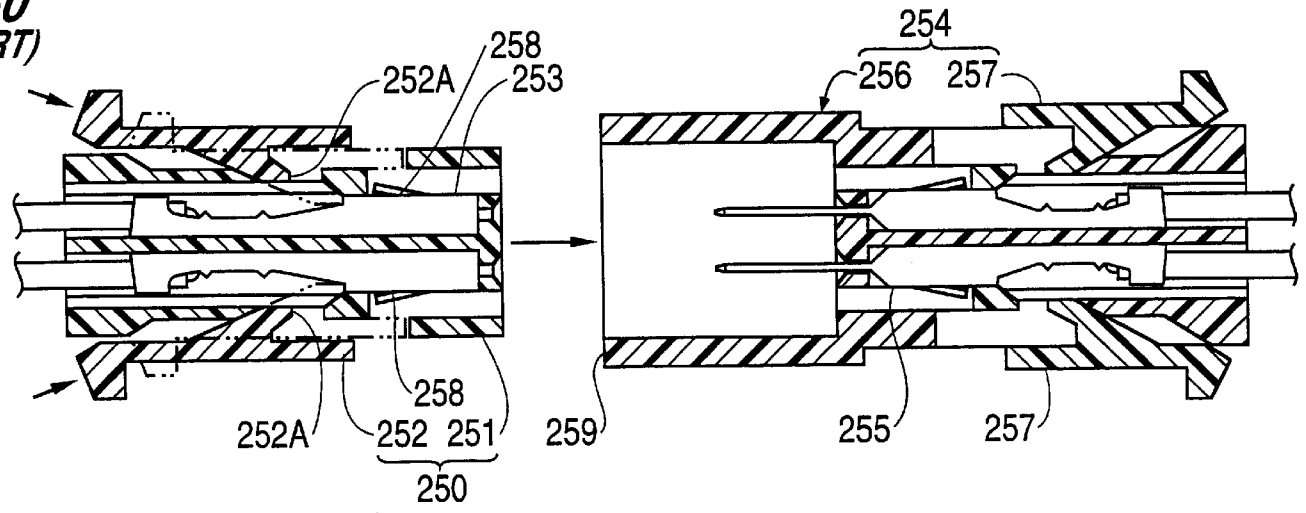
FIG. 30 (PRIOR ART)
FIG. 30 is a side cross-sectional view of a prior art female and male connector.
Figure 31:
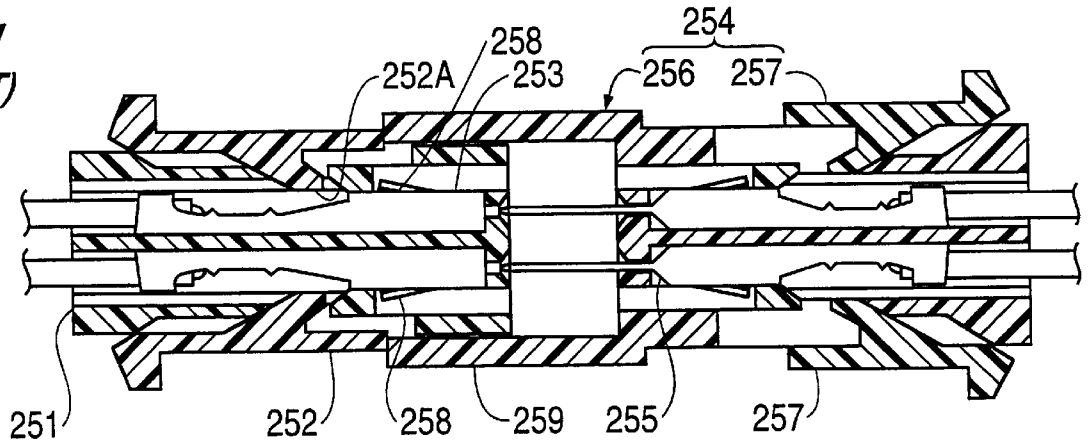
FIG. 31 (PRIOR ART)
FIG. 31 is a side cross-sectional view of the prior art connector and showing a fitting operation of the female and male connectors in the case where the connector housing and the retainer are not in the correct fitting position.

Next, a third embodiment of the present invention is explained with the help of FIG. 29. The main difference between the second embodiment and the third embodiment lies in the location of stopping grooves 183 provided in the female connector F3. Accordingly, only the relevant portions are shown and an explanation of the remaining configuration is omitted.

The stopping grooves 183 are provided as a pair on the lower side of the left and right side portions at the anterior end face of the female connector F3. These stopping grooves 183 are provided so as to be located somewhat towards the interior with respect to side walls 184 of the female connector F3. For this reason, compared to the stopping groove 161 of the second embodiment, there is in addition a side wall face 184A at each end.

The same operation and effects are achieved as in the case of the second embodiment when the female connector F3, configured as described above, and a male connector (not shown) are fitted together.

Furthermore, in the present embodiment, in the case where a contact protrusion of a retainer attached to a male connector (none of these are shown) is inserted into the stopping groove 183, since the side wall faces 184A are provided, the strength of fitting between the female connector F3 and the retainer on the male side increases. As a result, it becomes even harder to remove the retainer.

The present invention is not limited to the embodiments described above with the aid of figures. For example, the possibilities described below also lie within the technical range of the present invention.

In the present embodiment, a case was described where the retainer is attached to the connector housing from its side face. That is, the retainer is attached in a direction that is at a right angles to the fitting direction. However, the retainer may equally be attached from the anterior side or the posterior side of the housing.

The invention may also be applied to a female connector.

I claim:

1. A connector assembly comprising connectable male and female connector housings each having respective electrical terminals therein, wherein each housing further includes an insertable retainer movable between a temporary position in which respective terminals can be inserted and removed from the associated housing, and a final position in which the respective terminals are retained against removal from the respective housing, the housings each being adapted to retain retainers of the mating housing in the final position when the housings are fully connected.

2. A connector assembly according to claim 1 wherein, in the final position, the retainers are inserted more deeply in to a respective housing than in the temporary position.

3. A connector assembly according to claim 2 wherein in the final position the outer surfaces of the retainers are flush with the outer surfaces of the respective housings.

4. A connector assembly according to claim 1 wherein one of a retainer and a respective mating housing includes a guiding surface engageable with the other of the retainer and mating housing whereby movement of the housings to the connected condition urges said retainer to the final position.

5. A connector assembly according to claim 4 wherein the guiding surface comprises a tapered surface, said surface being angled with respect to connection axis of said housings.

6. A connector assembly according to claim 4 wherein both of the retainer and respective mating housing have mutually engageable guiding surfaces.

7. A connector assembly according to claim 4 wherein both retainers and both mating housings have a respective guiding surface.

8. A connector assembly according to claim 1 and further including resilient means to bias said housings apart.

9. A connector assembly according to claim 8 wherein said resilient means is disengaged wherein said housings are fully connected.

10. A connector assembly according to claim 1 wherein one of said housings, includes a resilient cantilever latch arm having a protrusion, and the other of said housings includes a recess to accommodate said protrusion when the housings are fully connected.

11. A connector assembly comprising connectable male and female connector housings each having respective electrical terminals therein, wherein each housing further includes an insertable retainer movable between a temporary position in which respective terminals can be inserted and removed from the associated housing, and a final position in which the respective terminals are retained against removal from the respective housing, the retainers each having an abutment engageable with the mating housing to prevent the housings from being fully connected if both retainers are not in the final position.

12. A connector assembly according to claim 11 wherein, in the final position, the retainers are inserted more deeply in to a respective housing than in the temporary position.

13. A connector assembly according to claim 12 wherein in the final position the outer surfaces of the retainers are flush with the outer surfaces of the respective housings.

14. A connector assembly according to claim 11 wherein one of a retainer and a respective mating housing includes a guiding surface engageable with the other of the retainer and mating housing whereby movement of the housings to the connected condition urges said retainer to the final position.

15. A connector assembly according to claim 14 wherein the guiding surface comprises a tapered surface, said surface being angled with respect to connection axis of said housings.

16. A connector assembly according to claim 14 wherein both of the retainer and respective mating housing have mutually engageable guiding surfaces.

17. A connector assembly according to claim 14 wherein both retainers and both mating housings have a respective guiding surface.

18. A connector assembly according to claim 11 wherein one of said housings, includes a resilient cantilever latch arm having a protrusion, and the other of said housings includes a recess to accommodate said protrusion when the housings are fully connected.

* * * * *